US005306176A

United States Patent [19]

Coffey

[11] Patent Number: 5,306,176

[45] Date of Patent: Apr. 26, 1994

[54] PROTECTOR FOR ELECTRICAL CORD CONNECTIONS

[76] Inventor: Eugene M. Coffey, P.O. Box 328, Kemah, Tex. 77565

[21] Appl. No.: 9,584

[22] Filed: Jan. 26, 1993

[51] Int. Cl.[5] ..... H01R 13/62

[52] U.S. Cl. ..... 439/367; 439/369

[58] Field of Search ..... 439/367, 368, 369, 370, 439/180, 476, 484, 521

[56] References Cited

U.S. PATENT DOCUMENTS

| | | | |
|---|---|---|---|
| 3,680,036 | 7/1972 | McCamis et al. | 439/367 X |
| 4,784,612 | 11/1988 | Ryan | 439/367 |
| 4,940,424 | 7/1990 | Odbert | 439/367 X |
| 5,037,324 | 8/1991 | Scheffey, Sr. | 439/367 X |

*Primary Examiner*—Larry I. Schwartz
*Assistant Examiner*—Khiem Nguyen
*Attorney, Agent, or Firm*—Keneth A. Roddy

[57] ABSTRACT

A protector for protecting the mating plug and socket of connected electrical cords from damage and contamination and which allows quick disconnection of the plug and socket in an isolated chamber. The protector has a tubular housing formed of high impact plastic, preferably transparent, which surrounds the mating plug and socket members of connected electrical cords and resilient end plugs which are slidably received on the cords rearwardly of the plug and socket. The end plugs have a longitudinal slit extending radially from a central longitudinal bore and are installed by pressing them laterally onto the cords then sliding them axially on the cords to press them into the open ends of the tubular housing. When pressed into the ends of the housing, the end plugs define a central chamber surrounding the plug and socket connection and form a seal at the opposed ends of the chamber between the housing and the exterior of the cords. The coefficient of friction between the end plugs and interior of the housing is greater than the coefficient of friction between the end plugs and the cords such that the end plugs remain frictionally engaged with the interior of the housing while allowing relative sliding movement between the cords and end plugs. When the cords are pulled apart, the plug and socket separate completely while enclosed in the sealed chamber to isolate any spark or arc and continued axial movement pulls the end plugs from the ends of the housing.

13 Claims, 2 Drawing Sheets

PROTECTOR FOR ELECTRICAL CORD CONNECTIONS

BACKGROUND OF THE INVENTION

1. Field of the Invention

This invention relates generally to the field of devices for protecting the mating plug and socket ends of electrical cords, and more particularly to a protector for protecting the mating plug and socket of connected electrical cords from damage and contamination and which allows quick disconnection of the plug and socket in an isolated chamber.

2. Brief Description of the Prior Art

Electrical cords, such as extension cords, are common in industrial facilities, outdoor construction sites, and manufacturing facilities. Often the mating plug and socket ends of these types of electrical cords are simply connected together and lie, unprotected, on the floor or ground and are subject to being pulled apart accidentally and to being damaged by pedestrian or vehicular traffic or being crushed by piping, beams, tools, etc. The unprotected connection is also be exposed to water, mud, and other contaminants, which may cause injury to personnel and corrosion of the mating components.

In some environments, the sparking or arc caused by pulling the mating plug and socket ends of electrical cords apart can cause an explosion. In some instances, the mating plug and socket ends of electrical cords are tied or otherwise secured together to prevent them from being separated accidentally. Securing the mating plug and socket ends of electrical cords together is not satisfactory, since it is important to be able to quickly break the electrical connection in the event of an emergency. For example, if a machine malfunctions or a worker is caught in a machine.

There are several patents which disclose various protectors and retainers for the mating plug and socket ends of electrical cords. Most of which secure the connection together and prevent the plugs from being pulled apart.

Gartland, Jr., U.S. Pat. No. 4,003,622, Burke, Jr., U.S. Pat. No. 4,721,475, Odbert, U.S. Pat. No. 4,940,424, and Bresko, U.S. Pat. No. 4,998,891 disclose devices for maintaining the male and female plugs of an electrical cord connected together. The device comprises a first cylindrical member which surrounds the male plug and a second cylindrical member which surrounds the female plug. The cylindrical members are secured on the cords behind each plug and one member has protuberances which slide and latch in grooves in the other member to prevent the plugs from being pulled apart.

Gallagher, U.S. Pat. No. 4,169,643 discloses a cylindrical clip for maintaining the male and female plugs of an electrical cord connected together. The clip is a hollow cylindrical housing made in two halves and hinged along one side and provided with latches on the opposite side. The housing surrounds an electrical connection and is latched around the electrical plug connection to prevent the electrical plugs from being pulled apart.

House et al, U.S. Pat. No. 4,643,505 discloses a hinged housing for maintaining the plugs of an extension cord connected together. Washers are installed on the cords behind each plug and each half of the housing has a series of parallel spaced internal grooves which surround and engage the washers to prevent the plugs from being pulled apart.

Ryan, U.S. Pat. No. 4,784,612 discloses an electrical plug holder for maintaining the male and female plugs of an electrical cord connected together. The device comprises a first cylindrical member which surrounds the male plug and a second cylindrical member which surrounds the female plug. The cylindrical members are threadedly secured together by mating helix threads to prevent the plugs from being pulled apart.

Scheffey, Sr., U.S. Pat. No. 5,037,324 discloses a plug and socket retainer for maintaining the plug and socket of an electrical cord connected together. The device comprises a cylindrical housing having a longitudinal slit for receiving the cord and which surrounds the connected plug and socket. The housing is provided with a pair of longitudinal serrated projections. A cover member also having a longitudinal slit is installed on the other electrical cord and provided with slits which receive and engage the serrated projections of the housing to prevent separation and prevent the plugs from being pulled apart.

Koch, U.S. Pat. No. 5,052,939 discloses a cylindrical protector for preventing unauthorized use of an electrical plug. The protector is a hollow cylindrical housing made in two halves and hinged along one side and provided with mating lips on the opposite side. The housing surrounds an electrical connection and is either bolted or locked around the electrical plug connection. The electrical plugs cannot be pulled apart.

The present invention is distinguished over the prior art in general, and these patents in particular by a protector for protecting the mating plug and socket of connected electrical cords from damage and contamination and which allows quick disconnection of the plug and socket in an isolated chamber. The protector has a tubular housing formed of high impact plastic, preferably transparent, which surrounds the mating plug and socket members of connected electrical cords and resilient end plugs which are slidably received on the cords rearwardly of the plug and socket. The end plugs have a longitudinal slit extending radially from a central longitudinal bore and are installed by pressing them laterally onto the cords then sliding them axially on the cords to press them into the open ends of the tubular housing. When pressed into the ends of the housing, the end plugs define a central chamber surrounding the plug and socket connection and form a seal at the opposed ends of the chamber between the housing and the exterior of the cords. The coefficient of friction between the end plugs and interior of the housing is greater than the coefficient of friction between the end plugs and the cords such that the end plugs remain frictionally engaged with the interior of the housing while allowing relative sliding movement between the cords and end plugs. When the cords are pulled apart, the plug and socket separate completely while enclosed in the sealed chamber to isolate any spark or arc and continued axial movement pulls the end plugs from the ends of the housing.

SUMMARY OF THE INVENTION

It is therefore an object of the present invention to provide a protector for electrical connections which will protect the plug and socket of an electrical cord from damage when they are lying on the floor or ground.

It is another object of this invention to provide a protector for electrical connections which surrounds and seals the plug and socket of electrical cords to prevent corrosion and damage caused by water, mud, and debris.

Another object of this invention to provide a protector for electrical connections which will allow the status of the connection to be easily seen.

Another object of this invention is to provide a protector for electrical connections which will surround and maintain a seal around the plug and socket members of connected cords while they are being disconnected to isolate any spark which occurs during disconnection and prevent the spark from causing an explosion.

A further object of this invention is to provide a protector for electrical connections which is easily and quickly installed and will allow the plug and socket of connected cords to be easily and quickly disconnected by pulling the cords apart axially.

A still further object of this invention is to provide a protector for electrical connections which is simple in construction, economical to manufacture, and rugged and reliable in usage.

Other objects of the invention will become apparent from time to time throughout the specification and claims as hereinafter related.

The above noted objects and other objects of the invention are accomplished by a protector for protecting the mating plug and socket of connected electrical cords from damage and contamination and which allows quick disconnection of the plug and socket in an isolated chamber. The protector has a tubular housing formed of high impact plastic, preferably transparent, which surrounds the mating plug and socket members of connected electrical cords and resilient end plugs which are slidably received on the cords rearwardly of the plug and socket. The end plugs have a longitudinal slit extending radially from a central longitudinal bore and are installed by pressing them laterally onto the cords then sliding them axially on the cords to press them into the open ends of the tubular housing. When pressed into the ends of the housing, the end plugs define a central chamber surrounding the plug and socket connection and form a seal at the opposed ends of the chamber between the housing and the exterior of the cords. The coefficient of friction between the end plugs and interior of the housing is greater than the coefficient of friction between the end plugs and the cords such that the end plugs remain frictionally engaged with the interior of the housing while allowing relative sliding movement between the cords and end plugs. When the cords are pulled apart, the plug and socket separate completely while enclosed in the sealed chamber to isolate any spark or arc and continued axial movement pulls the end plugs from the ends of the housing.

DESCRIPTION OF THE PREFERRED EMBODIMENT

Figure 1:
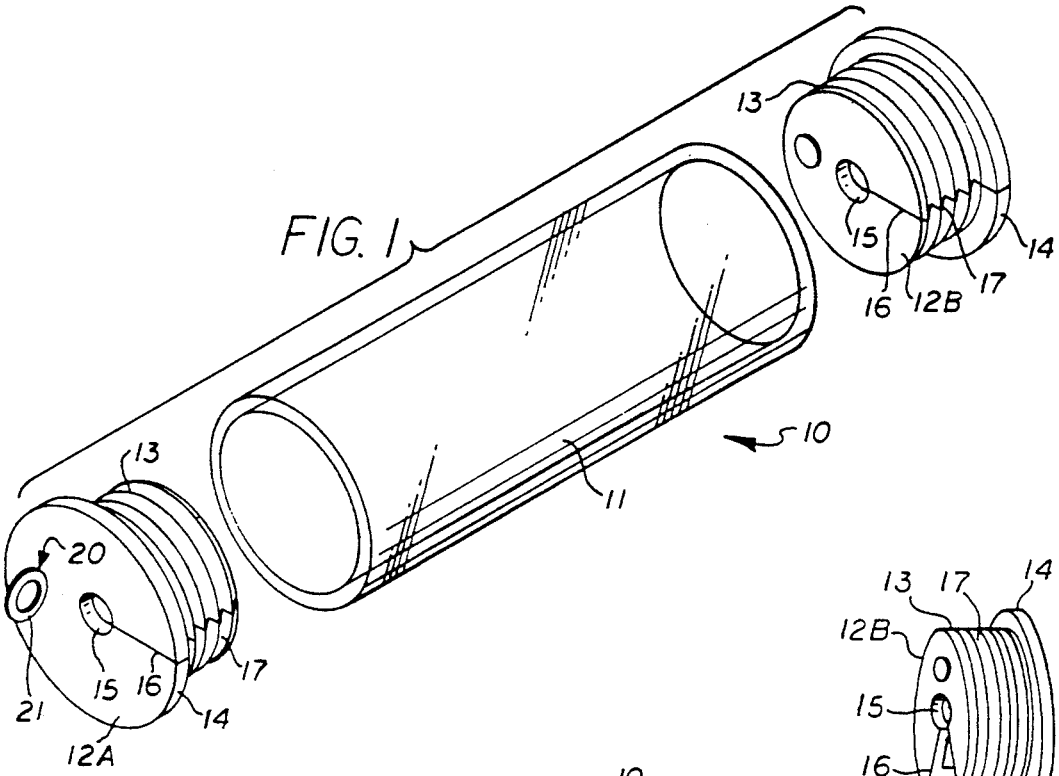
FIG. 1 is an exploded isometric view of the protector for electrical connections in accordance with the present invention.

Referring to the drawings by numerals of reference, there is shown in FIG. 1, a preferred protector for electrical connections 10. shown in an unassembled condition. The protector 10 includes a hollow cylindrical tube 11 open at each end and a pair of end plugs 12A and 12B. The tube 11 is formed of electrically non-conductive high impact plastic material. The preferred tube 11 is transparent so that the status of the connection can be observed.

Figure 2:
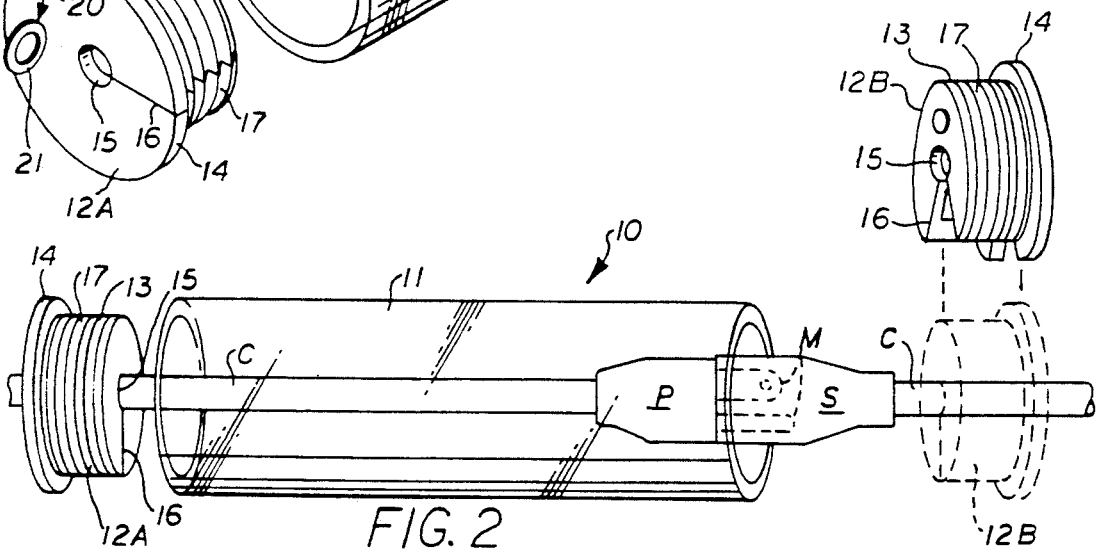
FIG. 2 is a perspective view of the protector for electrical connections being installed on a conventional plug and socket connection of an extension cord.
Figure 3:
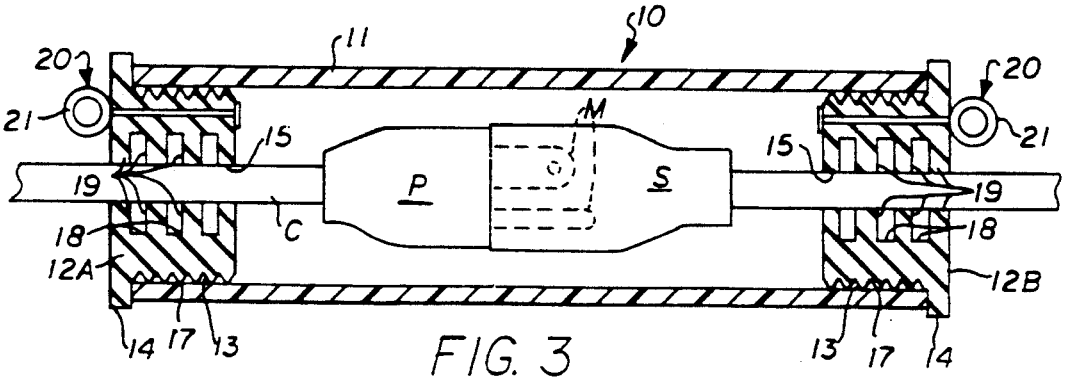
FIG. 3 is a longitudinal cross section through the protector for electrical connections shown in installed condition.

Referring additionally to FIGS. 2 and 3, the end plugs 12A and 12B are formed of electrically non-conductive resilient flexible material such as rubber or plastic. The exterior of each end plug 12A, 12B has a reduced diameter portion 13 which is slidably received on the interior diameter in the open end of the tube 11 and a radial flange portion 14 of larger diameter at one end which engages the end of the tube. Each end plug 12A, 12B has a longitudinal bore 15 which extends through the center and is slightly smaller in diameter than the electrical cord C on which it is to be installed. A longitudinal slit 16 extends radially from the central bore 15 to the exterior of the end plug.

The exterior of the reduced diameter portion 13 of the end plugs 12A and 12B are provided with a series of parallel, longitudinally spaced grooves defining raised ridges 17 to form a gripping surface. The interior of the end plugs 12A and 12B are provided with a series of parallel, longitudinally spaced grooves 18 which are larger in diameter than the central bore 15 and define thin flexible disks 19 therebetween. Other configurations will be described hereinafter.

The end plugs 12A and 12B may also be provided with a pull tab or pull ring 20. The pull ring 20 has a ring or grasping portion 21 which extends outwardly from the outer end of the end plug and a shank portion 21 which is secured longitudinally through the body of the end plug. The pull ring 20 may be installed during the molding operation of the end plugs or otherwise anchored by conventional means.

FIGS. 2 and 3 show a female socket S and a male plug P of a conventional electrical extension cord C with the protector 10 installed thereon. To install the protector 10, the tube 11 is slid over the male plug P or female socket S and the plug and socket are connected together. As seen in FIG. 2, the end plugs 12A and 12B are spread apart to allow them to be installed laterally on the cord C rearward of the male plug P and female socket S. When initially installed, there is no compressive force on the end plugs 12A and 12B and they can slide axially on the cords C. The tube 11 is centered over the connected plug and socket and the end plugs 12A and 12B are slid toward the open ends of the tube. The end plugs 12A and 12B are then pressed into the open ends of the tube 11.

When pressed into the ends of the tube 11, the reduced diameter 13 is compressed, the slit 16 closes and the central bore 15 extending through the flexible disks 19 conforms to the outside diameter of the electrical cord C. The ridges 17 on the reduced diameter portion 13 sealingly engage the interior diameter of the tube and the flexible disks 19 sealingly engage the outside diameter of the cord C. Thus, the end plugs 12A and 12B form a seal at the opposed ends of the tube between the interior diameter of the tube and the outside diameter of the electrical cord.

Figure 4:
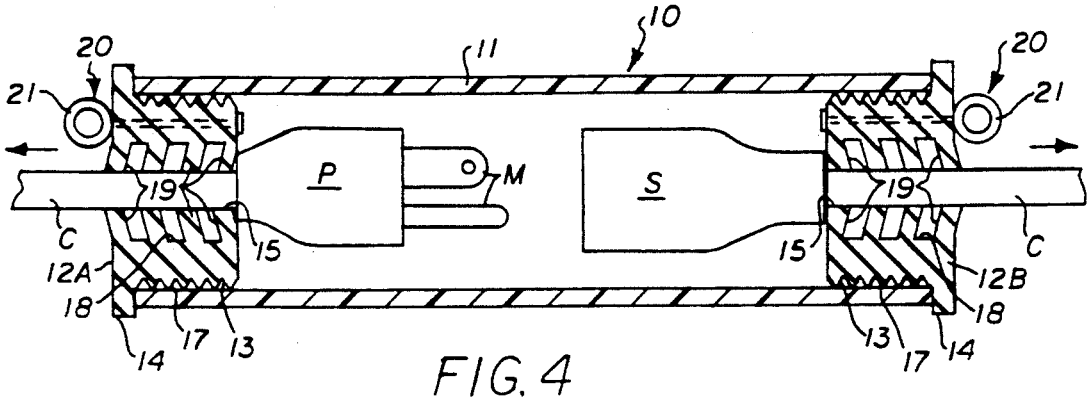
FIG. 4 is a longitudinal cross section through the protector showing the plug and socket being pulled apart.

As seen in FIGS. 3 and 4, the length of the tube 11 is sufficient to provide an interior chamber with the end plugs 12A and 12B installed of sufficient length to allow clearance between the inward facing ends of the end plugs and the rearward ends of the male plug P and female socket S members so that when pulled apart, the metal conductors M of the plug will be completely withdrawn from the socket S with space therebetween before the rearward ends of the plug and socket contact the inward facing ends of the end plugs.

The elasticity and exterior and interior configuration of the end plugs 12A and 12B is such that the coefficient of friction between the ridges 17 of the reduced diameter 13 of the end plugs 12A and 12B and the interior diameter of the tube 11 is greater than the coefficient of friction between the flexible disks 19 and outside diameter of the cords C.

Thus, as the cords C are pulled apart axially (FIG. 4), the flexible disks 19 will flex outwardly in the direction of the pulling force while still maintaining a seal on the cord C. As the pull continues, the male plug P and female socket S members will separate and the metal conductors M of the plug will be completely withdrawn from the socket S with space therebetween before the rearward ends of the plug and socket contact the inward facing ends of the end plugs. At this point in time, there is still a seal at the opposed ends of the tube between the interior diameter of the tube and the outside diameter of the electrical cord.

Figure 5:
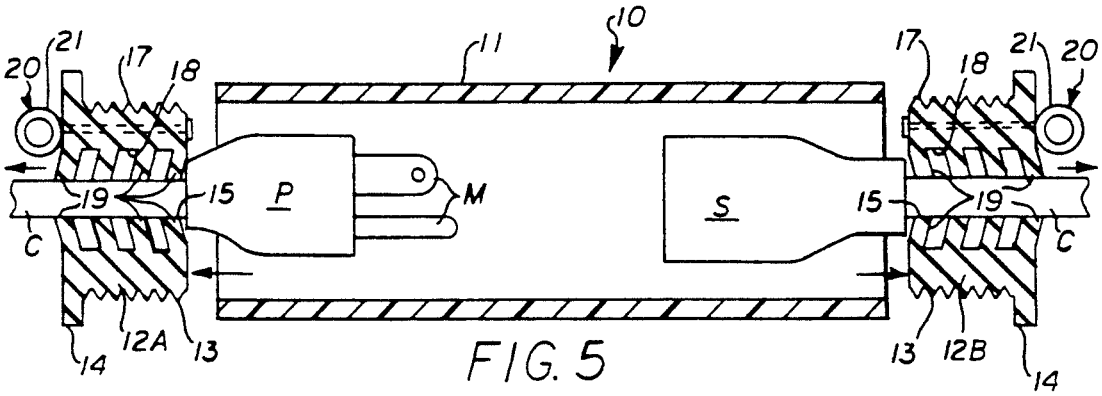
FIG. 5 is a longitudinal cross section through the protector showing the end plugs being pulled out of the tube by the plug and socket members.

As seen in FIG. 5, as pulling continues, the rearward ends of the plug P and socket S contact the inward facing ends of the end plugs 12A and 12B and pull the end plugs out of the ends of the tube The end plugs 12A and 12B may also be removed manually by grasping the pull ring 20 and pulling outwardly.

Figure 6:
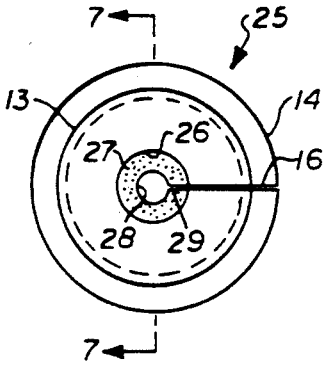
FIG. 6 is an end view of alternate embodiment of an end plug member.
Figure 7:
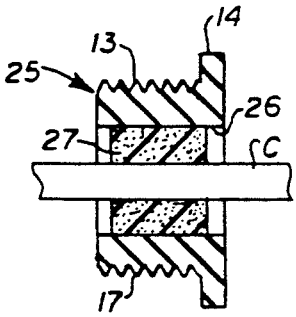
FIG. 7 is a longitudinal cross section of the end plug member of FIG. 6.

FIGS. 6 and 7 show an alternate embodiment of the end plugs 25 wherein the flexible disk arrangement in the interior of the of the end plug is replaced by a flexible material insert. In this embodiment, the exterior of each end plug has the previously described reduced diameter portion 13 and radial flange portion 14. The exterior of the reduced diameter portion 13 may also be provided with the raised ridges 17 to form a gripping surface. The end plug 25 has a longitudinal bore 26 which extends through the center and is larger in diameter than the electrical cord C on which it is to be installed. A longitudinal slit 16 extends radially from the central bore 15 to the exterior of the end plug.

A tubular insert 27 is secured in the central bore 25 by epoxy or other conventional means and has a concentric central bore 28 which is smaller in diameter than the electrical cord C on which it is to be installed. A longitudinal slit 29 extends radially from the central bore 28 through the side wall of the insert 27 in alignment with the slit 16 to form a continuous slit to the exterior of the end plug. In this embodiment, the insert 27 is formed of an electrically non-conductive resilient flexible material such as foam rubber or plastic which may have different sealing, elasticity, and friction characteristics from the material forming the exterior of the end plug.

Thus, the end plug 25 may be provided with different materials on the interior and exterior which provide a greater coefficient of friction between the reduced diameter portion of the end plug and the interior of the tube 11 than the coefficient of friction between the flexible insert 27 and outside diameter of the cords C. Such that the end plug 25 is frictionally maintained in sealing relation in the end of the tube 11 while the insert 27 allows the cords C to slide therethrough while maintaining a seal around the cords.

One of the important features of the present invention is that its construction allows the mating cords to be pulled apart axially such that the male plug P and female socket S members will completely separate and the metal conductors M of the plug after separation will still be completely surrounded by the tube 11 which is sealed at both ends. The spark or arc which often occurs when electrical cords are disconnected is isolated in the chamber of the tube. Thus, the protector is particularly suitable for use in environments wherein the sparking or arc caused by pulling the mating plug and socket ends of electrical cords apart can cause an explosion.

Another important feature is that the tube 11 is transparent, and the plug and socket members can be easily seen to determine whether or not they are properly connected or disconnected. The plug and socket can be easily disconnected in an emergency situation, should it become necessary to break the connection. The protector also prevents damage to the plug and socket in normal usage and seals the connection against water, mud, and debris.

While this invention has been described fully and completely with special emphasis upon a preferred embodiment, it should be understood that within the scope of the appended claims the invention may be practiced otherwise than as specifically described herein.

I claim:

1. A protector for protecting the plug and socket members of connected electrical cords comprising;

a hollow tubular housing open at each end slidably received over the connected plug and socket members, a pair of end plug members slidably engaged on each electrical cord rearward the plug and socket members for axial movement relative to the cords and configured to be received and releasably engaged one at each end of said tubular housing to define a hollow chamber therebetween, the plug and socket members of the connected electrical cords being enclosed in said chamber when said end plugs are engaged on said tubular housing, the plug and socket members being disconnected from each other upon opposed pulling forces applied axially on the electrical cords, and said chamber being of sufficient length to allow complete separation of the plug and socket members while enclosed in said chamber.

2. The protector according to claim 1 wherein each said end plug member is frictionally engaged one at each end of said tubular housing, and each said end plug member has an exterior configured to form a seal on the interior of said tubular housing at each end of said chamber and an interior configured to form a sliding seal on the exterior of the cord on which it is engaged, such that the plug and socket members of the connected electrical cords are enclosed and sealed in said chamber.

3. The protector according to claim 2 wherein each said end plug member is formed of electrically non-conductive resilient material of sufficient elasticity such that the coefficient of friction between said end plug member and the interior of said tubular housing is greater than the coefficient of friction between said end plug interior and the cord on which it is slidably and sealingly engaged whereby said end plug member will remain frictionally engaged with the interior of said tubular housing while allowing relative sliding movement between the cord and said end plug interior.

4. The protector according to claim 2 wherein each said end plug member is formed of electrically non-conductive resilient material having a central longitudinal bore and a longitudinal slit extending radially from said central bore to the exterior of said end plug, and each said end plug is engaged on the electrical cord by placing said slit on the cord and pressing said end plug laterally onto the cord until the cord is received in the central bore.

5. The protector according to claim 4 wherein each said end plug member has a cylindrical portion at one end of sufficient diameter to be slidably received and frictionally engaged in the open end of said tubular housing and is radially compressed when engaged therein to seal said slit closed.

6. The protector according to claim 4 wherein each said end plug member has a cylindrical portion at one end of sufficient diameter to be slidably received and frictionally engaged in the open end of said tubular housing and the exterior of said cylindrical portion is configured to provide a gripping surface to facilitate frictional engagement.

7. The protector according to claim 4 wherein said central longitudinal bore is of sufficient diameter to form a sliding seal on the exterior of the cord on which it is engaged.

8. The protector according to claim 7 wherein said central longitudinal bore is configured to flexibly engage the cord on which it is installed and form a sliding seal thereon.

9. The protector according to claim 4 including an insert formed of electrically non-conductive resilient material secured within the central longitudinal bore of said end plug member and having a central longitudinal bore concentric therewith and a longitudinal slit extending radially from said central bore in alignment with said end plug member longitudinal slit to form an extension thereof, said insert central longitudinal bore being received on the exterior of the electrical cord and is of sufficient diameter to form a sliding seal on the exterior of the cord on which it is engaged, and the relative elasticity of said end plug member and said insert are such that the coefficient of friction between said end plug member and the interior of said tubular housing is greater than the coefficient of friction between said insert longitudinal bore and the cord on which it is slidably and sealingly engaged whereby said end plug member will remain frictionally engaged with the interior of said tubular housing while allowing relative sliding movement between the cord and said insert.

10. The protector according to claim 9 wherein each said end plug member has a cylindrical portion at one end of sufficient diameter to be slidably received and frictionally engaged in the open end of said tubular housing and is radially compressed when engaged therein to seal said slits closed and to compress said insert to effect a sliding seal on the exterior of the cord on which it is engaged.

11. The protector according to claim 9 wherein each said end plug member has a cylindrical portion at one end of sufficient diameter to be slidably received and frictionally engaged in the open end of said tubular housing and the exterior of said cylindrical portion is configured to provide a gripping surface to facilitate frictional engagement.

12. The protector according to claim 1 wherein said tubular housing is of sufficient length and said end plug members define a chamber therebetween of sufficient length to allow the plug and socket members to engage the opposed inward facing surfaces of said end plug members after complete separation upon continued opposed pulling forces applied axially on the electrical cords to pull said end plug members from the ends of said tubular housing.

13. The protector according to claim 1 wherein;

said tubular housing is transparent to allow visibility form the exterior of said housing of the status of the plug and socket members within said housing.

* * * * *